US011595770B2

(12) United States Patent
Naumann et al.

(10) Patent No.: US 11,595,770 B2
(45) Date of Patent: Feb. 28, 2023

(54) METHOD FOR OPERATING A HEARING DEVICE, AND HEARING DEVICE

(71) Applicant: SIVANTOS PTE. LTD., Singapore (SG)

(72) Inventors: Frank Naumann, Bubenreuth (DE); Umut Goekay, Koenigswinter (DE)

(73) Assignee: Sivantos Pte. Ltd., Singapore (SG)

( * ) Notice: Subject to any disclaimer, the term of this patent is extended or adjusted under 35 U.S.C. 154(b) by 18 days.

(21) Appl. No.: 17/018,242

(22) Filed: Sep. 11, 2020

(65) Prior Publication Data

US 2021/0076146 A1 Mar. 11, 2021

(30) Foreign Application Priority Data

Sep. 11, 2019 (DE) ..... 102019213807

(51) Int. Cl.
*H04R 25/00* (2006.01)
*G10K 11/178* (2006.01)

(52) U.S. Cl.
CPC ..... *H04R 25/70* (2013.01); *G10K 11/17873* (2018.01); *H04R 25/505* (2013.01);
(Continued)

(58) Field of Classification Search
CPC H04R 25/70; H04R 2460/01; H04R 2460/05; H04R 25/505; H04R 1/1083; H04R 29/00; H04R 25/305; G10K 11/17873; G10K 2210/1081; G10K 2210/3011; G10K 2210/3027; G10K 2210/3044
(Continued)

(56) References Cited

U.S. PATENT DOCUMENTS 7,010,131 B1 * 3/2006 Rhode ..... H03F 3/68 330/69
8,107,656 B2 1/2012 Dressler et al.
(Continued)

FOREIGN PATENT DOCUMENTS

CN 101989423 A 3/2011
CN 102625220 A 8/2012
(Continued)

OTHER PUBLICATIONS

Walter J. Kozacky et al.: "An active noise control algorithm with gain and power constraints on the adaptive filter", EURASIP Journal on Advances in Signal Processing, Dec. 1, 2013 (Dec. 1, 2013), XP055766685, DOI: 10.1186/1687-6180-2013-17.

*Primary Examiner* — Norman Yu
(74) *Attorney, Agent, or Firm* — Laurence A. Greenberg; Werner H. Stemer; Ralph E. Locher

(57) ABSTRACT

A method operates a hearing device which performs active noise suppression for suppressing noise signals having one or more frequency components. An audiogram is provided which specifies a hearing threshold of a user of the hearing device as a function of frequency, wherein by using the audiogram it is determined which frequency components of the noise are audible to the user and which are not audible. The noise suppression is operated selectively by suppressing audible frequency components of the noise and by not suppressing inaudible frequency components of the noise. A corresponding hearing device is operated according to the method.

10 Claims, 2 Drawing Sheets

(52) U.S. Cl.
CPC ..... *G10K 2210/1081* (2013.01); *G10K 2210/3011* (2013.01); *G10K 2210/3027* (2013.01); *G10K 2210/3044* (2013.01); *H04R 2460/01* (2013.01); *H04R 2460/05* (2013.01)

(58) Field of Classification Search
USPC ..... 381/56, 317, 60, 58, 23.1, 312, 71.1, 381/71.11
See application file for complete search history.

(56) References Cited

U.S. PATENT DOCUMENTS

| | | | | |
|---|---|---|---|---|
| 9,437,182 | B2 | 9/2016 | Doclo | |
| 2011/0026724 | A1 | 2/2011 | Doclo | |
| 2012/0215056 | A1* | 8/2012 | Hillbratt | H04R 25/505 600/25 |
| 2014/0079235 | A1* | 3/2014 | Lyons | G10K 11/17821 381/71.6 |
| 2015/0222999 | A1* | 8/2015 | Rasmussen | A61B 5/123 381/60 |
| 2018/0021176 | A1* | 1/2018 | Bernier | H04R 1/04 381/72 |
| 2018/0151172 | A1 | 5/2018 | Min | |
| 2019/0130926 | A1 | 5/2019 | Giri et al. | |

FOREIGN PATENT DOCUMENTS

| | | | |
|---|---|---|---|
| DE | 102006051071 | B4 | 12/2010 |
| WO | 2018004547 | A1 | 1/2018 |

* cited by examiner

METHOD FOR OPERATING A HEARING DEVICE, AND HEARING DEVICE

CROSS-REFERENCE TO RELATED APPLICATION

This application claims the priority, under 35 U.S.C. § 119, of German application DE 10 2019 213 807, filed Sep. 11, 2019; the prior application is herewith incorporated by reference in its entirety.

BACKGROUND OF THE INVENTION

Field of the Invention

The invention relates to a method for operating a hearing device and to a corresponding hearing device.

A hearing device is used to output sounds to a hearing device user. The user wears the hearing device on or in the ear. The hearing device has a receiver for outputting sounds. In addition, some hearing devices have at least one microphone and are configured as hearing aid devices to detect sounds from the environment and then output them to the user. The sounds are typically additionally modified by the hearing device, e.g. to compensate for a hearing loss of the user. In general, a hearing device in this description not only means hearing aids for hearing-impaired users, but also headphones and the like, which of course can also be used by users with a hearing loss, but which do not necessarily compensate for the loss.

For example, a hearing device can have active noise suppression, or active noise cancellation (ANC) for short, by means of which sounds from the environment, especially intrusive noise, are suppressed so that the user can experience a quieter hearing situation. In a similar way, an active occlusion reduction, or AOR, can also be used to create a quieter hearing situation. An ANC suppresses noise that enters the user's auditory canal from the external environment. In contrast, an AOR suppresses those sounds which are produced by the user him/herself or which result from standing waves in the auditory canal. This is particularly the case if the ear canal is closed off from the environment, either predominantly or completely, by an earpiece. In both cases, sounds that are usually perceived as disturbing by the user are therefore suppressed, thus creating a quieter hearing situation.

ANC and AOR, and in general any active noise suppression technique, consume appropriate levels of energy in use and thus contribute to the energy consumption of a hearing device. An energy storage device of the hearing device, or an external device connected to it, is loaded accordingly. However, in hearing devices and hearing aids in particular, high energy consumption conflicts with requirements regarding installation space and mobility. The energy store cannot be selected with arbitrary size but should nevertheless allow as long and uninterrupted use of the hearing device as possible.

BRIEF SUMMARY OF THE INVENTION

Against this background, an object of the invention is to realize an active noise cancellation for a hearing device having the minimum possible energy consumption. To this end, an improved method for operating a hearing device and a corresponding hearing device will be specified.

The object is achieved according to the invention by a method having the features according to the independent method claim and by a hearing device having the features according to the independent hearing device claim. Advantageous configurations, extensions and variants form the subject matter of the dependent claims. In these, the comments in relation to the method also apply, mutatis mutandis, to the hearing device, and vice versa.

With the foregoing and other objects in view there is provided, in accordance with the invention, a method for operating a hearing device having active noise cancelling for suppression of noise signals having at least one frequency component. The method includes providing an audiogram specifying a hearing threshold of a user of the hearing device in dependence on frequency. The audiogram is used to determine which frequency components of noise are audible to the user and which are not audible. The noise suppression is operated selectively by suppressing audible frequency components of the noise and by not suppressing inaudible frequency components of the noise.

The method is used to operate a hearing device, and so it is an operating method. This is implemented in particular during the intended use of the hearing device, namely when a user wears the hearing device on or in the ear and when the hearing device is switched on. The hearing device has an active noise cancellation function to suppress noise. Noise consists of acoustic signals, i.e. sound signals. The term "noise" is also used to mean individual sounds, without restriction of generality. Typically, however, multiple noise signals are present. The noise cancellation suppresses noise in such a way that a quieter listening situation is created for the user. "Active" means, in particular, that the noise suppression generates counter-noise, e.g. in the form of anti-sound, in order to eliminate some or all noise signals at least partially and preferably completely. The counter-noises are generated in such a way that they are superimposed with the noise signals and are thus phase-shifted with respect to them in such a way that the noises are suppressed as a result. This reduces the level of the noise for the user.

In contrast to "active", a "passive" type of noise cancellation is then understood to mean that noise is suppressed by means of a sound insulation, e.g. in the form of special materials or special enclosure or covering of the user's ear or auditory canal. Such a passive noise cancellation is not a mandatory addition to the active noise suppression, but is beneficial. Another difference between active and passive noise cancellation is that the active noise cancellation requires energy, which is extracted from an energy storage device, e.g. a battery. The energy storage device is preferably a part of the hearing device.

Furthermore, an audiogram of the hearing device user is provided. The audiogram indicates a hearing threshold of the user as a function of frequency. In particular, the audiogram is stored in a memory of the hearing device. The audiogram is determined in particular in an appropriate test or calibration procedure, for example by an audiologist or by the hearing device itself in a designated operating mode. The audiogram typically differs from user to user. The audiogram indicates a hearing threshold for a series of frequency components of a frequency spectrum, above which the respective frequency component is audible to the user. In other words, the audiogram indicates the user-specific hearing threshold for an overall frequency spectrum as a function of frequency. The audiogram thus contains a function which indicates the individual hearing threshold of the user for a given frequency component. The hearing threshold is a level, i.e. an amplitude. The hearing thresholds of the various frequencies together form a hearing curve. In a graphical representation, the hearing curve divides the space defined by the two dimensions of level and frequency into two regions, namely an actually inaudible region underneath the hearing curve and an actually audible region above the hearing curve.

A "frequency component" means a single frequency or a frequency range of a plurality of frequencies. Preferably, the hearing device decomposes the sounds into a number of consecutive frequency bands and thus into the same number of frequency components, so that each frequency component is then assigned to exactly one of the frequency bands of the hearing device. The separation is not necessarily sharp; instead, in one possible configuration the frequency bands and hence also the frequency components overlap in a peripheral region for technical reasons.

The audiogram is thus formed in such a way that it can be used to determine which sounds are audible to the user and which are not audible. Any given sound consists of either: both audible and non-audible frequency components, or of purely audible or non-audible frequency components. The composition is logically user-dependent and can also be different for different users for the same sound. A frequency component is audible to the user if and only if this frequency component has a level which exceeds the hearing threshold of the user for this frequency range. Otherwise, the frequency range is inaudible. For those sounds that are present at a given time during operation, the audiogram specifies which frequency components of those sounds exceed the corresponding hearing threshold and are therefore actually audible to the user, and those which do not exceed the corresponding hearing threshold and are therefore inaudible. In addition, the audiogram also generally indicates which frequency components are more clearly audible to the user, i.e. for which the hearing threshold is low, and which are less audible, i.e. for which the hearing threshold is high.

In the present case the audiogram is used to determine which frequency components of the sounds are audible to the user and which are not audible. This determination is preferably carried out as part of the method and thus during operation. In particular, this means that the actual sounds present at a given time during operation are examined and their audible and inaudible frequency components are identified. Which frequency components are audible based on the audiogram and which are not, on the other hand, is specified in advance by the audiogram itself and does not necessarily need to be determined during the method, since the audiogram is usually fixed throughout the method. In other words, the sounds are divided into audible and inaudible frequency components based on the known audiogram. For this purpose, the sounds are detected, in particular, with a microphone of the hearing device and fed to a control unit of the hearing device. The audible and inaudible frequency components are not necessarily sharply distinct from each other, but in fact overlap under certain circumstances, albeit typically only slightly. For example, in so-called "dead regions" on the cochlea, it is not readily possible to assign individual cells on the basilar membrane precisely to specific frequency components. Instead, a respective frequency range can be covered by several cells in an overlapping manner, so that the loss of the hearing facility for certain frequency components occurs progressively and, so to speak, subtly with the increased loss of cells. For example, an ever increasing amplitude is then required in order to remain able to hear the frequency component.

In the present case the noise suppression is operated selectively by suppressing audible frequency components of the noise and by not suppressing inaudible frequency components of the noise. This means, in particular, that the audible frequency components are actively suppressed and the non-audible frequency components are not actively suppressed. In this process, not necessarily all, but preferably all, audible frequency components are suppressed. Likewise, not necessarily all, but preferably all inaudible frequency components are not suppressed. Preferably, only audible frequency components are suppressed, so that none of the inaudible frequency components is suppressed.

The audible and inaudible frequency components determined on the basis of the audiogram correspond preferably to actually audible or actually inaudible frequency components, respectively. However, this is not actually absolutely necessary, instead it is sufficient that the audiogram is or will be used to determine that a respective frequency component is actually audible or inaudible with overwhelming probability or in an overwhelming majority of listening situations or the like. For example, a frequency component for which the hearing threshold is very high and is, for example, 100 dB, is considered an inaudible frequency component, although at least sounds above 100 dB would actually be audible at the corresponding frequencies, but such levels occur less frequently than levels below 100 dB. Whether a frequency component of the audiogram is defined as audible or inaudible can therefore differ from whether it is actually audible or not. This depends in particular on the specific way in which the noise suppression is selectively operated. In general, however, the noise suppression is conveniently operated in a selective manner such that by applying a definition based on the audiogram, a given frequency component is identified as audible or inaudible correctly, i.e. in agreement with the actual situation, with an overwhelming probability.

An essential aspect of the invention is in particular the fact that the audiogram is used to distinguish between audible and inaudible frequency components on a user-specific basis, i.e. individually, and the noise components are then suppressed according to the needs of the user. Thus, at a given time, only those frequency components of the noise are suppressed which according to the audiogram are audible to the user, or more precisely, which would be audible to the user without noise suppression activated. The noise suppression is therefore selectively used only for such frequency components for which their suppression also has a sufficient benefit for the user. Overall, the noise suppression acts in particular like a filter, which filters out only audible frequency components and is thus a user-specific filter. On the other hand, inaudible frequency components are also not suppressed, which therefore saves energy since no active measures such as the generation of anti-sound are carried out for inaudible frequency components. The noise suppression thus places a significantly lower load on the energy storage device of the hearing device and leads to an overall lower energy consumption of the hearing device.

The invention is based in particular on the insight that such frequency components, which the user does not hear at all, also do not need to be actively suppressed. Therefore, these non-audible frequency components are omitted in the suppression process by operating the noise suppression selectively. However, it is not only those frequency components which are already outside the acoustic spectrum and therefore inaudible to any human being irrespective of the user which are not suppressed, rather the individual audiogram of the user is specifically used to perform the suppression on an individual basis. The acoustic spectrum perceptible by humans is generally limited to a frequency range from 10 Hz to 20 kHz, so that frequency components outside the acoustic spectrum are also ignored by the noise suppression, irrespective of the user. It is relevant in the present case that one or more frequency ranges within the acoustic spectrum are selectively not suppressed, i.e. are excluded from the noise suppression.

The inaudible frequency ranges within the acoustic spectrum are determined on the basis of the audiogram on a user-specific basis and can therefore be differently positioned relative to the overall frequency spectrum and vary in their extent. For example, the user has a hearing deficit under which the hearing threshold in the range from 1 kHz to 2 kHz is at least 100 dB. Sounds at these frequencies and below this hearing threshold are then not perceptible to the user, i.e. are not audible, and are therefore not actively suppressed when present.

It is largely of secondary importance whether the user is hearing-impaired, i.e. has a hearing loss, hearing damage or a hearing deficit in the sense of a pathological condition. In itself, it is of course advantageous that the individual hearing ability of the user, whether healthy or hearing impaired, is taken into account at all by means of the individual audiogram. Since the selective operation of the noise suppression depends on the audiogram of the user, the noise suppression is therefore a personalized noise suppression. This procedure is particularly preferred in the case of a hearing-impaired user, since in this case the audiogram is typically measured anyway in order to characterize the hearing capacity quantitatively. Consequently, the measurement and incorporation of the audiogram are also advantageous for a healthy user, since the consideration of the individual hearing ability using a personalized noise suppression also leads to energy savings when operating the hearing device. In this respect, the method is not only suitable for hearing devices that are configured as hearing aids, i.e. configured to compensate for a user's hearing loss. Rather, the method is also suitable for headphones, headsets and the like, which in themselves only output useful sounds, e.g. music, to the user, but wherein these useful sounds are superimposed by other sounds, e.g. from the environment. These other sounds are then suppressed in a user-specific manner by means of the noise suppression. This is in contrast to a simple, broadband noise cancellation, which suppresses all frequency components without distinction between audible and inaudible frequency ranges and thus requires more energy than the selective noise suppression described here.

In this case, two variants are particularly suitable for distinguishing audible and inaudible frequency components and thus for implementing a selective noise suppression. These two variants are explained in more detail below and are referred to as the first and second variants.

In the first variant the noise suppression is operated in an amplitude-selective manner, by not suppressing those frequency components which have a level below the hearing threshold, so that only those frequency components in which the level is above the hearing threshold are actively suppressed. For this purpose, in particular, the respective level of a frequency component is compared with the corresponding hearing threshold of the audiogram and those frequency components which have a level above the hearing threshold are considered as audible frequency components, whereas those frequency components which have a level below the hearing threshold are considered as inaudible frequency components. A distinction is thus made according to the level, i.e. the amplitude of the frequency components relative to the audiogram, so that the noise suppression is then amplitude-selective. This has the advantage that an active suppression of the sounds occurs only above the hearing threshold and not unnecessarily earlier, below the hearing threshold. Depending on the situation, it is then also possible that all frequency components are audible or inaudible, so that all frequency components are either suppressed or not suppressed accordingly. For example, if the user has a constant hearing threshold of 60 dB for all frequency components, then all frequency components are suppressed or not suppressed frequency-independently, so to speak, depending exclusively on their amplitude.

Preferably, a maximum level is defined which specifies a power limit of the hearing device, and those frequency components with levels above the maximum level are not suppressed. The maximum level is also referred to as the direct sound threshold or the external sound threshold, since the maximum level is compared with an input level, i.e. the level of the actual noise present, as opposed to an output level, i.e. the level of the sound which is output to the user by the receiver. The output level is limited because of the power limit. The maximum level indicates the level above which suppression of the respective frequency component is no longer meaningful or no longer possible, due to technical limitations of the hearing device. Such technical limitations are the result, for example, of a maximum power of the receiver or a power amplifier stage of the hearing device. Since above the maximum level an effective suppression cannot be performed with the hearing device, in this case the suppression is advantageously omitted and the frequency component is excluded from the noise suppression, although it may be audible. The maximum level is normally above the respective hearing threshold, but this is not mandatory, especially in such frequency ranges in which the user has a hearing deficit. A frequency-dependent maximum level is suitable in principle, but a constant maximum level for all frequency components is preferred. For example, a suitable maximum level is 140 dB. The use of a maximum level in combination with an amplitude-selective noise suppression is particularly advantageous, but not essential, instead a maximum level as described can also be generally used for selective noise suppression.

In the second variant, the audiogram has one or more dead regions within which the hearing threshold is above a minimum level, and the noise cancellation is operated frequency-selectively by not suppressing those frequency components which lie within a dead region of the audiogram, so that only those frequency components which are not located within a dead region of the audiogram are actively suppressed. In the audiogram, one or more frequency ranges are defined as dead regions by virtue of the fact that the respective hearing threshold of the frequencies within the dead region is above the minimum level. A respective dead region thus characterizes a frequency range in which the user has particularly poor hearing. In a suitable design the minimum level is 90 dB. In the dead regions no noise suppression generally takes place, regardless of the level. Any frequency components that fall within a dead region are considered inaudible and hence not suppressed. Frequency components which lie outside all dead regions, however, are considered audible and are advantageously actively suppressed. A distinction is thus made according to the frequency of the frequency components relative to the dead regions of the audiogram, so that the noise suppression is then frequency-selective. The distinction as to whether a frequency component is audible or not is therefore made by examining whether the frequency component is within a dead region or not, and is therefore primarily independent of whether its level exceeds the hearing threshold or not. The division into audible and non-audible frequency components thus corresponds more to an expectation regarding audibility, which is derived from the audiogram, and not necessarily to the actual audibility. Nevertheless, this procedure ensures adequate noise suppression while simultaneously conserving energy.

A dead region is characterized in particular by the fact that exceeding the high hearing threshold within the dead region compared to the rest of the audiogram tends to be unlikely or even impossible. In general, a dead region of the audiogram starts from a lower frequency and extends to an upper end frequency, and between these two frequencies, also called cutoff frequencies, the hearing threshold is consistently above the minimum level. A distinction is made between general and specific dead regions. While general dead regions are located at the edge of the acoustic spectrum, where the hearing curve generally tapers off toward high levels for any user, specific dead regions are not at the edges, but within the frequency spectrum. A specific dead region also characterizes an actual hearing deficit of a hearing-impaired user, whereas a general dead region characterizes a natural hearing deficit, which may indeed also be individual but which is not due to a pathological condition and is present in one form or another for all users. A specific dead region is therefore also referred to as a hearing-deficit dead region and a general dead region is known as a natural dead region.

Preferably, a local maximum of the hearing threshold falls within the dead region, so that the latter frames the maximum, so to speak, and thus covers a frequency range in which the user has particularly poor hearing. Such a local maximum is obtained particularly in the case of a hearing deficit dead region, but typically not in the case of a natural dead region at the edge of the acoustic spectrum.

As described above, the noise suppression is therefore advantageously operated amplitude-selectively or frequency-selectively. A design in which these two variants are combined is particularly preferred, so that the noise suppression is then operated in an amplitude- and frequency-selective manner. In the audiogram, due to the hearing curve overlapping with the dead regions, one or more regions are formed which arise as the intersection of the audible range and the dead regions. These regions therefore include all frequency components that are not in a dead region and the level of which is above the corresponding hearing threshold. Preferably, only those frequency components which due to their frequency and level are located in one of these regions are actively suppressed by means of the noise suppression, whereas the other frequency components are not actively suppressed. The regions are therefore also referred to as active regions. In this case, only those frequency components that lie both outside the dead regions and above the respective hearing threshold are then suppressed, whereas the other frequency ranges are not actively suppressed, since these are not perceived by the user in any case.

The sounds are either intrusive noise or useful sounds, or a combination of both. In general, the hearing device is advantageously configured to discriminate useful sounds from intrusive noise and to predominantly or exclusively suppress the intrusive noise by means of the active noise suppression, whereas the useful sounds are output to the user predominantly or completely unaffected by the noise suppression. Useful sounds include, for example, the speech of a conversation partner, the user's speech, music, warning signals or the like. Intrusive sounds are in particular noise, plant or machine noise, background noises and the like. Preferably, the active noise suppression is thus only applied to the intrusive sounds.

Preferably, the active noise suppression has an active intrusive noise suppression which suppresses intrusive ambient noise by recording the noise interference with an external microphone of the hearing device and outputting it in inverted form via a receiver of the hearing device. The external microphone is mounted in particular on or in a housing of the hearing device and generally faces outwards, i.e. it is not inserted in the user's auditory canal. The external microphone therefore primarily picks up sounds from the user's environment, including possibly intrusive noise. The active noise suppression is then used to suppress noise from the user's environment. Active noise suppression is also known as ANC (active noise cancellation).

Alternatively or additionally, the active noise cancellation has an active occlusion reduction which suppresses intrusive noise arising from an occlusion in the user's auditory canal, by recording the intrusive noise with an internal microphone of the hearing device in the user's auditory canal and outputting it in inverted form via a receiver of the hearing device. Active occlusion reduction is also referred to as AOR for short. An occlusion occurs in the normal usage of the hearing device, in particular due to an earpiece of the hearing device. For example, the ear piece is a so-called dome, an ear tip or an otoplastic, and is generally inserted into the user's ear canal, thus closing off the ear canal to the outside. As a result, a resonator is formed in the ear canal, which gives rise to unpleasant noises. These are recorded by means of the internal microphone. For this purpose, the internal microphone is advantageously attached to the earpiece and when inserted, is preferably also arranged in the resonator so that the user's own sounds and standing waves in the auditory canal are absorbed particularly efficiently and accordingly suppressed by means of the noise cancelling.

Preferably, the audiogram indicates the hearing threshold in a frequency range from at least 10 Hz to a maximum of 20 kHz, i.e. it comprises an overall frequency spectrum corresponding to the acoustic spectrum. At the edges of the audiogram, i.e. in particular below 20 Hz and above 16 kHz, the hearing ability of most people is normally poor, regardless of whether they are hearing-impaired or not. The hearing threshold here is typically above 90 dB. Therefore, frequency components at these edges are also not actively suppressed by the active noise cancelling.

In addition, it makes sense to exclude such frequency ranges, in which mostly useful signals are to be expected, from the noise cancelling from the outset provided that these useful signals are not already isolated by the hearing device and further processed separately. In a particularly advantageous design, a frequency range for speech is not suppressed by the noise suppression, regardless of whether the user has good or poor hearing in this range. Speech normally constitutes a useful signal, which if possible is preferably not cancelled by the noise suppression. A suitable frequency range for speech extends, in particular, from 300 Hz to 5 kHz or a partial range thereof.

A hearing device according to the invention has a control unit which is configured for carrying out a method as described above. The control unit is also known as a controller and is located in particular within a housing of the hearing device. The audiogram is advantageously stored in a memory which is a part of the control unit or is connected to the latter. The memory is preferably also part of the hearing device.

In a preferred design, the hearing device is designed as a hearing aid and has a signal processing unit for this purpose, for modifying input signals in order to compensate for a hearing loss of the user. The input signals are picked up by means of a microphone, specifically an external microphone, of the hearing device. The modification of the input signals takes place in the signal processing according to the audiogram, i.e. user-specifically. The modified input signals are then output signals of the signal processing and are forwarded to a receiver of the hearing device for output to the user.

Alternatively or additionally, the input signals are not or not exclusively generated by a microphone of the hearing device, but are electrical audio signals which are transmitted to the hearing device by a suitable playback device or are stored in the hearing device.

The input signals are preferably divided into a plurality of frequency bands by means of a filter bank of the hearing device, specifically the signal processing. For example, the filter bank has 48 channels and generates 48 frequency bands accordingly. A given frequency component is then suppressed by suppressing the frequency band in which the frequency component to be suppressed is located.

Preferably, the hearing device has a binaural design and comprises two individual devices, one for each of the two ears of the user. The method is then advantageously carried out separately on both sides, i.e. for both ears, since the hearing ability of the user is usually not identical for both ears. Consequently two audiograms are then provided, one for each side.

Other features which are considered as characteristic for the invention are set forth in the appended claims.

Although the invention is illustrated and described herein as embodied in a method for operating a hearing device, and a hearing device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
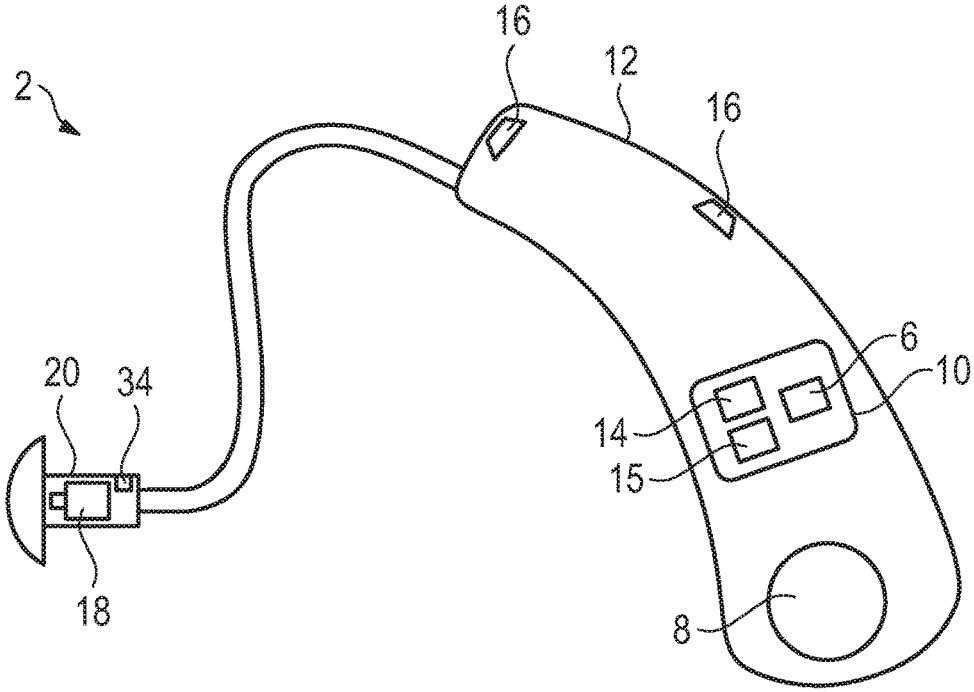
FIG. 1 is an illustration of a hearing device.
Figure 2:
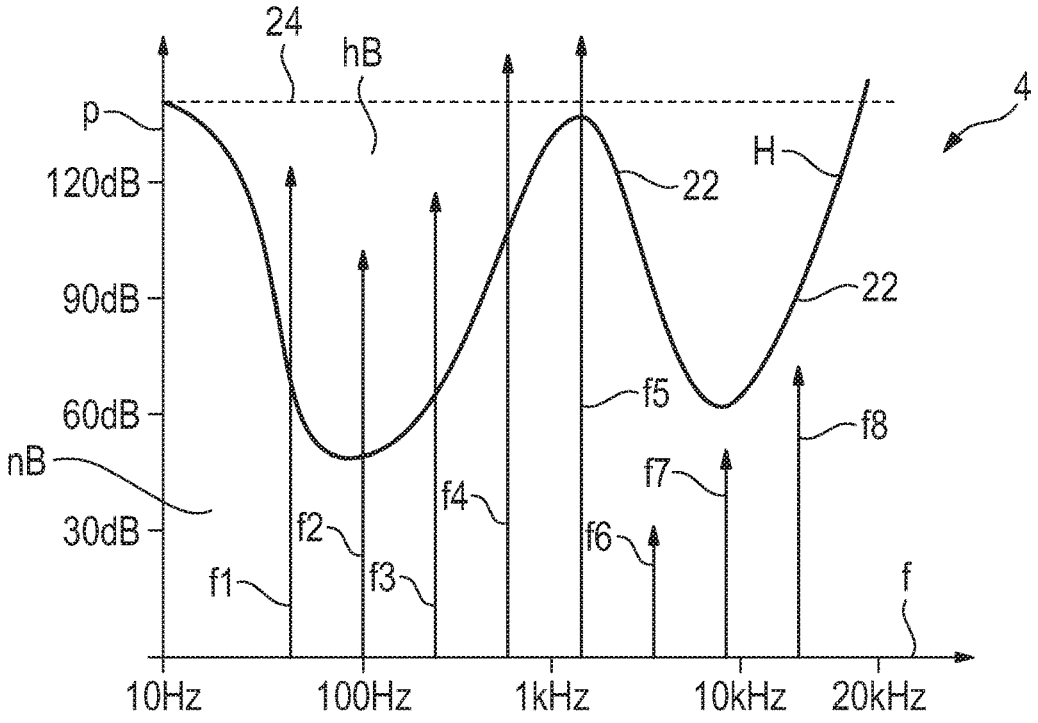
FIG. 2 is a graph showing an audiogram and an amplitude-selective suppression of sounds.
Figure 3:
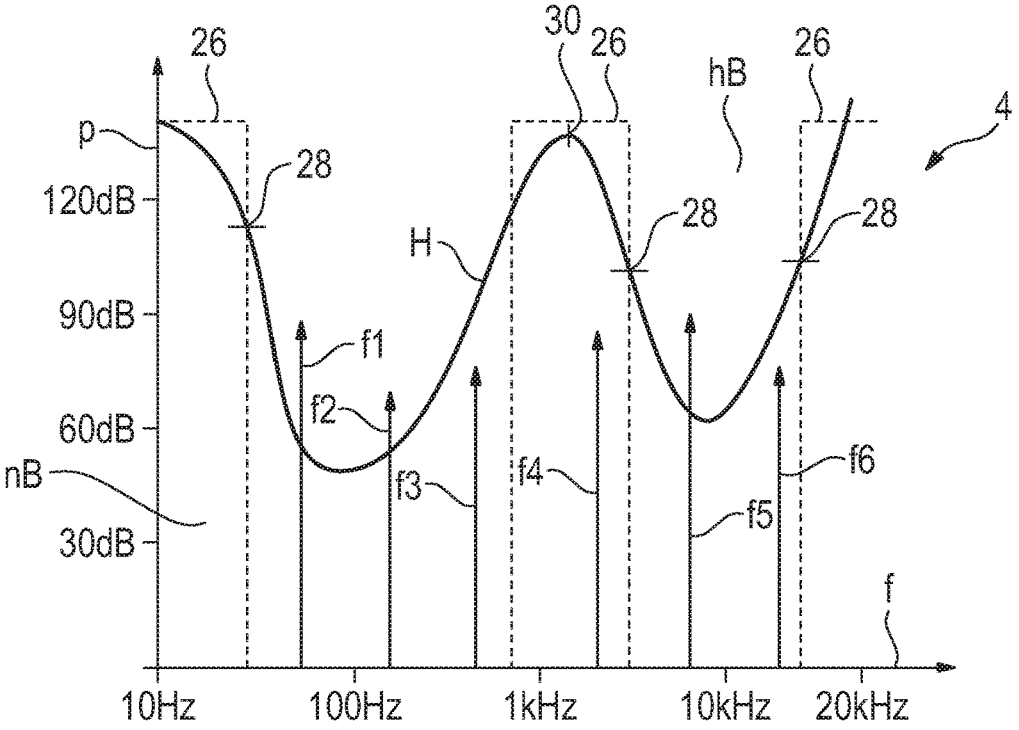
FIG. 3 is a graph showing the audiogram of FIG. 2 and a frequency-selective suppression of sounds.
Figure 4:
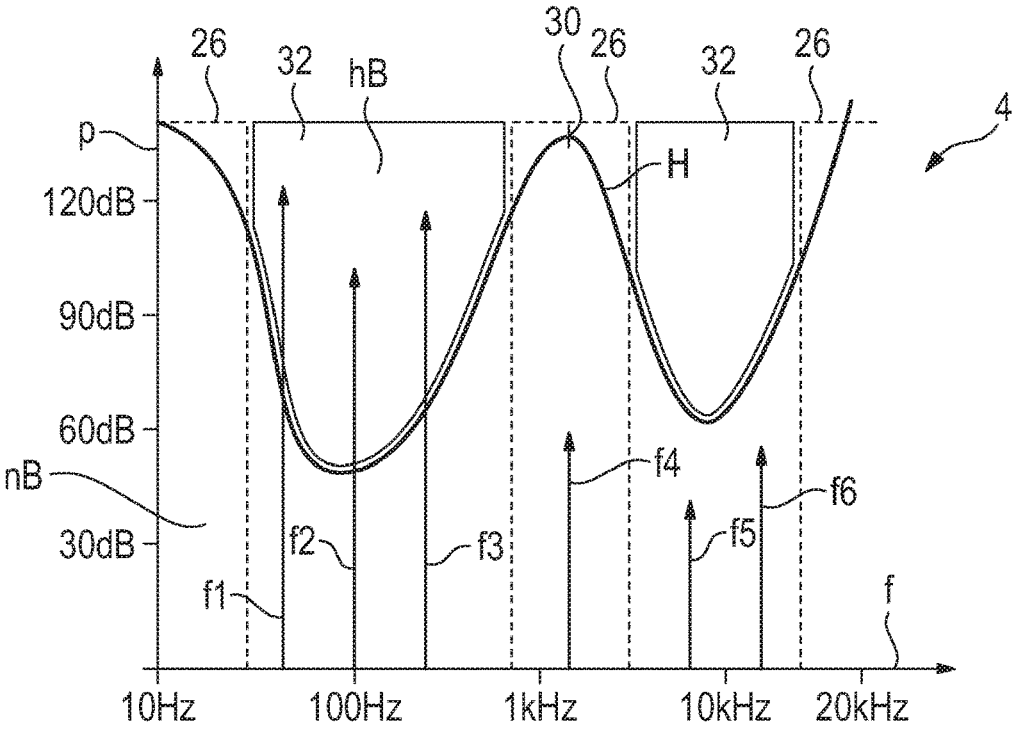
FIG. 4 is a graph showing the audiogram of FIG. 2 and an amplitude- and frequency-selective suppression of sounds.

Referring now to the figures of the drawings in detail and first, particularly to FIG. 1 thereof, there is shown an exemplary embodiment of a hearing device 2. In FIGS. 2 to 4, an example of an audiogram 4 of a user is shown, on the basis of which an active noise cancellation 6 of the hearing device 2 is selectively operated in different ways as part of a method for operating the hearing device 2. The active noise cancellation 6 is generally used to suppress noise, where the term "noise" is also intended to mean individual sounds, without limitation of generality. The noise cancellation 6 suppresses noise in such a way that a quieter listening situation is created for the user. This is carried out by generating counter-noise in order to partially or even completely eliminate the noise signals. This requires energy, which in this case is extracted from an energy storage device 8 of the hearing device 2.

The hearing device 2 in FIG. 1 has a control unit 10, which is configured to carry out the method. The control unit 10 is arranged inside a housing 12 of the hearing device 2. The audiogram 4 in this case is stored in a memory 14. The memory 14 and the noise cancellation 6 are each part of the control unit 10. This is not mandatory, however.

The hearing device 2 shown is configured as a hearing aid device to compensate for a hearing deficit of the user, and for this purpose has a signal processing unit 15, which is also part of the control unit 10. The signal processing unit 15 is used to modify input signals to compensate for the user's hearing deficit. The input signals are detected by means of a microphone 16 of the hearing aid 2, in FIG. 1 two external microphones 16 are shown. The modification of the input signals takes place in the signal processing 15 according to the audiogram 4, i.e. user-specifically. The modified input signals are then output signals of the signal processing 15 and are forwarded to a receiver 18 of the hearing device 2 for output to the user. The receiver 18, in the embodiment shown, is a part of an earpiece 20, which is inserted into the user's ear canal. Alternatively, the receiver 18 is arranged in the housing 12 and the sound signals generated by the receiver 18 are routed into the ear canal via a sound tube. Alternatively or additionally, the input signals are electrical audio signals, which are transferred to the hearing device 2 from a suitable playback device or are stored in the hearing device 2.

The input signals are divided into several frequency bands by means of a filter bank, not shown in detail, as part of the signal processing 15 of the hearing device 2, i.e. in the present case within the control unit 10. For example, the filter bank has 48 channels and generates 48 frequency bands accordingly. A given frequency component f1-f8 is then suppressed by suppressing the particular frequency band in which the frequency component f1-f8 to be suppressed is located.

FIG. 1 shows the hearing device with only one single device. In a variant not shown, the hearing device 2 has a binaural design and contains two individual devices, e.g. as in FIG. 1, one for each of the two ears of the user.

The audiogram 4 generally indicates a frequency-dependent hearing threshold 22 of the user and is determined, for example, in a corresponding test or calibration procedure. The audiogram 4 typically differs from user to user. The audiogram 4 shown in FIGS. 2 to 4 is therefore only one example from a plurality of possible audiograms 4. The audiogram 4 shown indicates, for each frequency f of a frequency spectrum from 10 Hz to 20 kHz, a hearing threshold 22 above which the respective frequency f is audible to the user, i.e. the user-specific hearing threshold 22 is specified as a function of frequency. The hearing threshold 22 is a level p, i.e. an amplitude. In FIGS. 2 to 4, a number of vertical arrows also show various frequency components f1-f8, each of which has a specific level p. The frequency components f1-f8 shown as examples are here individual frequencies, but are alternatively frequency ranges with a plurality of frequencies. The hearing thresholds 22 of the various frequencies f together form a hearing curve H. As will be evident from the graphical representations of FIGS. 2 to 4, the hearing curve H divides the space defined by the two dimensions of level p and frequency f into two regions, namely an actually inaudible region nB underneath the hearing curve H and an actually audible region hB above the hearing curve H.

The audiogram 4 is thus formed in such a way that it can be used to determine which sounds are audible to the user and which are not audible. A particular noise consists of one or more frequency components f1-f8, which are audible or inaudible, or a combination of these. A frequency component f1-f8 is audible to the user if and only if this frequency component f1-f8 has a level p which exceeds the hearing threshold 22 of the user for this frequency range. Thus, in FIG. 2 the frequency components f1-f5 are actually audible by the user, while the frequency components f6-f8 are not. In FIG. 3 the frequency components f1, f2, f5 are actually audible by the user, while the frequency components f4, f6 are not. In FIG. 4, the frequency components f1-f3 are actually audible by the user, whereas the frequency components f4-f6 are not.

The noise cancellation 6 is further operated selectively by suppressing audible frequency components f1-f8 of the noise and by not suppressing inaudible frequency components f1-f8 of the noise. The noise suppression 6 is therefore selectively used only for such frequency components f1-f8 for which their suppression also has sufficient benefit for the user. Such frequency components f1-f8, which the user cannot hear at all, do not need to be actively suppressed and are therefore ignored during the suppression. It is not only those frequency components f1-f8 which are already outside the acoustic spectrum, i.e. in FIGS. 2 and 4 below 20 Hz and above 20 kHz, that are not suppressed, but the individual audiogram 4 of the user is used to perform the suppression on an individual basis. Thus in the exemplary embodiment shown, the user is hearing-impaired and has a hearing deficit under which the hearing threshold 22 in the range from 1 kHz to 2 kHz is at least approximately 100 dB. Sounds at these frequencies and below this hearing threshold 22 are then not perceptible to the user, i.e. are not audible, and are therefore not actively suppressed.

Alternatively, the user is not hearing-impaired in the sense of a pathological condition. The noise cancellation 6 is generally a personalized noise cancellation 6. In this respect, the method is not only suitable for hearing devices 2 which are designed as hearing aids, for example as in FIG. 1, but also for headphones, headsets and the like, which in themselves mainly output useful sounds to the user, but these useful sounds are superimposed by other sounds. These other sounds are then suppressed in a user-specific manner by means of the noise cancellation 6.

Which frequency components f1-f8 of the sounds are audible to the user and which are not audible is determined by the audiogram 4. More specifically, it is determined on the basis of the audiogram 4 which frequency components f1-f8 are audible or cannot be perceived. The sounds are thus divided into audible and non-audible frequency components f1-f8 based on the known audiogram 4. Whether a frequency component f1-f8 of the audiogram 4 is determined as audible or inaudible can therefore differ in principle from whether it is actually audible or not, depending on the manner of operation of the selective noise cancellation 6. In general, however, the aim is to operate the noise cancellation in a selective manner such that the frequency component f1-f8 will be correctly identified as audible or inaudible with an overwhelming probability by applying a definition based on the audiogram 4.

In this case, two variants are particularly suitable for distinguishing audible and inaudible frequency components f1-f8 and thus for implementing a selective noise cancellation 6. On the basis of FIG. 2 an embodiment of the first variant is described, on the basis of FIG. 3 an embodiment of the second variant is described, and in the embodiment according to FIG. 4 both variants are combined with each other. In FIG. 2-4, a number of frequency components f1-f8 which form one or more sounds are also shown as examples. The frequency components f1-f8 shown represent the actually existing sounds, i.e. not the sounds that are output to the user via the receiver 18. These actual sounds normally enter the user's ear canal directly, but are sometimes further attenuated due to the earpiece 18. The actual sounds in this case also reach the microphone 16, are picked up by it, processed in the control unit 10 as appropriate, and output to the user via the receiver 18.

In FIG. 2 in accordance with the first variant the noise cancellation 6 is operated amplitude-selectively, by not suppressing those frequency components f6-f8 which have a level p below the corresponding hearing threshold 22, so that only those frequency components f1-f5 in which the level p is above the corresponding hearing threshold 22 are actively suppressed. For this purpose, the respective level p of a frequency component f1-f8 is compared with the corresponding hearing threshold 22 of the audiogram 4, and those frequency components f1-f5 which have a level p above the hearing threshold 22 are considered as audible frequency components f1-f5, whereas those frequency components f6-f8 which have a level p below the hearing threshold 22 are considered as inaudible frequency components f6-f8. A distinction is thus made according to the level p, i.e. the amplitude of the frequency components f1-f8 relative to the audiogram 4, more precisely relative to the hearing curve H. As a result, during the method the noise is actively suppressed above the hearing curve H and not unnecessarily so below it.

In addition, in the example of FIG. 2 a maximum level 24 is defined which specifies a power limit of the hearing device 2, and those frequency components f4, f5, the level p of which is above the maximum level 24, are not suppressed. The maximum level 24 indicates the level p above which suppression of the respective frequency component f1-f8 is no longer meaningful or no longer possible due to technical limitations of the hearing device 2. Such technical limitations are the result, for example, of a maximum power of the receiver 18 or a power amplifier stage of the hearing device 2. Since above the maximum level 24 an effective suppression cannot therefore be carried out with the hearing device 2, but instead arises automatically due to the power limit being exceeded, suppression is not used in this case and the frequency components f4, f5 are excluded from the noise cancellation 6, although in this case they are audible. However, at the output these frequency components f4, f5 are automatically reduced to the maximum level 24 due to the power limit. As is evident from FIG. 2, the maximum level 24 is normally above the respective hearing threshold 22. This is not essential, however. In this case, the maximum level 24 is constant for all frequencies f, whereas in a variant not shown, the maximum level 24 is frequency-dependent. The use of a maximum level 24 as described is independent of the amplitude-selective noise cancellation 6 described and can also be omitted.

In FIG. 3, according to the second variant, the noise cancellation 6 is operated frequency-selectively. Here the audiogram 4 additionally has one or more dead regions 26, within which the hearing threshold 22 is above a minimum level 28 in each case. The frequency-selective operation is implemented in such a manner that those frequency components f4 which are located within a dead region 26 of the audiogram 4 are not suppressed, so that only those frequency components f1-f3, f5, f6 which are not within a dead region 26 of the audiogram 4 are actively suppressed. A respective dead region 26 thus characterizes a frequency range in which the user's hearing is particularly poor. In the dead regions 26, the noise is generally not suppressed independently of the level p, i.e. regardless of whether the level p is above or below the hearing threshold 22. Any frequency components f4 which fall within a dead region 26 are considered inaudible and hence are not suppressed. Frequency components f1-f3, f4, f5, which are located outside all dead regions 26, are considered to be audible and are actively suppressed.

In general, a dead region 26 of the audiogram 4 extends from a lower frequency up to an upper frequency. Between these two frequencies, the hearing threshold 22 is consistently above the minimum level 28. FIG. 3 shows a total of three dead regions 26, wherein the two outer dead regions 26 are at the edge of the acoustic spectrum and are purely natural dead regions 26, i.e. dead regions 26 in the general sense and therefore not necessarily due to a hearing deficit. The middle dead region 26, on the other hand, is a dead region of hearing loss, i.e. due to a hearing deficit of the user, and is therefore a dead region 26 in the specific sense. While general dead regions 26 are located at the edge and the hearing curve H tapers off there, so to speak, towards high levels p, in contrast to this a specific dead region 26 can have a local maximum 30 of the hearing threshold 22 and can also frame the local maximum 30, as it were, as is the case in FIG. 3 for the middle dead region 26.

Based on FIG. 4, it will now be clear that the amplitude-selective and frequency-selective operation of the noise cancellation 6 can also be combined. By overlapping these two concepts, one or more active regions 32 are then formed in the audiogram in such a way that only those frequency components f1-f3 are suppressed which are both outside the dead regions 26 and also above the respective hearing threshold 22, whereas the other frequency ranges f4-f6 are not actively suppressed, since these are not perceived by the user in any case. As can be seen from FIG. 4, the active regions 32 result as an intersection of the audible range hB and the dead regions 26.

In FIGS. 2-4, the audiogram 4 indicates the hearing threshold 22 in a frequency range from 10 Hz to 20 kHz, i.e. it contains an overall frequency spectrum corresponding to the acoustic spectrum. At the edges of the audiogram, i.e. in particular below 20 Hz and above 16 kHz, as already indicated the hearing ability of most people is normally poor, regardless of whether they are hearing-impaired or not. The hearing threshold 22 here is typically above 90 dB, so that natural dead regions 26 are produced here. In addition, it makes sense to exclude such frequency ranges, in which mostly useful signals are to be expected, from the noise cancelling 6 from the outset, provided that these useful signals are not already isolated by the hearing device 2 and further processed separately. In a variant not explicitly shown, for example, a frequency range for speech similar to the dead regions 26 is not suppressed by the noise cancellation 6, regardless of whether the user has good or poor hearing there. Speech normally constitutes a useful signal, which is therefore preferably not cancelled by the noise suppression if at all possible. A suitable frequency range for speech ranges from 300 Hz to 5 kHz or over a partial range thereof.

In the exemplary embodiment shown in FIG. 1, the active noise suppression 6 has active noise cancelling (ANC for short), more precisely, is implemented as such. Accordingly the noise suppression 6 suppresses intrusive ambient noise by recording the intrusive noise with one or both of the external microphones 16 of the hearing device 2 and outputting it in inverted form via the receiver 18 of the hearing device 2.

In a variant not shown, the active noise cancelling 6 has an active occlusion reduction (AOR for short) or is implemented as such a system, and suppresses intrusive noise arising from an occlusion in the user's auditory canal by recording the noise interference with an internal microphone 34 of the hearing device 2 in the user's auditory canal and outputting it in inverted form via the receiver 18 of the hearing device 2. FIG. 1 shows an internal microphone 34 as part of the earpiece 18. Without AOR, the internal microphone 34 is purely optional.

LIST OF REFERENCE SIGNS

2 hearing aid
4 audiogram
6 noise suppression
8 energy store
10 control unit
12 housing
14 memory
15 signal processor
16 external microphone
18 receiver
20 earpiece
22 hearing threshold
24 maximum level
26 dead region
28 minimum level
30 local maximum
32 active region
34 internal microphone
f frequency
f1-f8 frequency component
H hearing curve
hB actual audible range
NB actual inaudible range
p level

The invention claimed is:

1. A method for operating a hearing device having active noise cancelling for suppression of noise signals having at least one frequency component, which comprises the step of:

providing an audiogram specifying a hearing threshold of a user of the hearing device in dependence on frequency, the audiogram is used to determine which frequency components of noise are audible to the user and which are not audible, the audiogram having at least one dead region within which the hearing threshold is above a minimum level; and operating noise suppression selectively dependent on the audiogram by suppressing audible frequency components of the noise and by not suppressing inaudible frequency components of the noise, an operation of the noise suppression is frequency-selective, by not suppressing the frequency components which are disposed within the at least one dead region of the audiogram, so that only the frequency components which are not within the at least one dead region of the audiogram are actively suppressed.

2. The method according to claim 1, wherein an operation of the noise suppression is amplitude-selective, by not suppressing the frequency components which have a level below the hearing threshold, so that only the frequency components in which the level is above the hearing threshold are actively suppressed.

3. The method according to claim 2, which further comprises:

defining a maximum level which specifies a power limit of the hearing device; and not suppressing the frequency components having the level which is above the maximum level.

4. The method according to claim 1, wherein a local maximum of the hearing threshold is disposed within said at least one dead region.

5. The method according to claim 1, wherein the noise suppression suppresses intrusive ambient noise by recording the intrusive ambient noise with an external microphone of the hearing device and outputting it in inverted form via a receiver of the hearing device.

6. The method according to claim 1, wherein the noise suppression has an active occlusion reduction which suppresses intrusive noise arising from an occlusion in a user's auditory canal, by recording the intrusive noise with an internal microphone of the hearing device in the user's auditory canal and outputting it in inverted form via a receiver of the hearing device.

7. The method according to claim 1, wherein the audiogram specifies the hearing threshold in a frequency range from at least 10 Hz to at most 20 kHz.

8. The method according to claim 1, wherein a frequency range for speech is not suppressed by the active noise cancelling.

9. A hearing device, comprising:

a controller configured to perform a method of operating the hearing device having active noise cancelling for suppression of noise signals having at least one frequency component, the method comprises the step of:

providing an audiogram specifying a hearing threshold of a user of the hearing device in dependence on frequency, the audiogram is used to determine which frequency components of noise are audible to the user and which are not audible, the audiogram having at least one dead region within which the hearing threshold is above a minimum level; and operating noise suppression selectively dependent on the audiogram by suppressing audible frequency components of the noise and by not suppressing inaudible frequency components of the noise, an operation of the noise suppression is frequency-selective, by not suppressing the frequency components which are disposed within the at least one dead region of the audiogram, so that only the frequency components which are not within the at least one dead region of the audiogram are actively suppressed.

10. The hearing device according to claim 9, wherein said controller has a signal processor for modifying input signals to compensate for a hearing impairment of the user.

* * * * *